US005690028A

United States Patent [19]

Schick

[11] Patent Number: 5,690,028

[45] Date of Patent: Nov. 25, 1997

[54] WET TRAPPING METHOD AND APPARATUS FOR LOW VISCOSITY RADIATION CURED PRINT

[75] Inventor: Philip W. Schick, Knowlton, N.Y.

[73] Assignee: Cavanagh Corporation, Flemington, N.J.

[21] Appl. No.: 659,632

[22] Filed: Jun. 6, 1996

[51] Int. Cl.[6] ..... B41F 5/16

[52] U.S. Cl. ..... 101/211; 101/181

[58] Field of Search ..... 101/181, 177, 101/211

[56] References Cited

U.S. PATENT DOCUMENTS

| | | | |
|---|---|---|---|
| 3,593,661 | 7/1971 | Tripp | 101/175 |
| 4,035,214 | 7/1977 | Shuppert et al. | 156/240 |
| 5,062,360 | 11/1991 | Germann et al. | 101/152 |
| 5,136,942 | 8/1992 | Germann | 101/177 |
| 5,611,278 | 3/1997 | Garner et al. | 101/349 |

*Primary Examiner*—Edgar S. Burr
*Assistant Examiner*—Dave A. Ghatt
*Attorney, Agent, or Firm*—Kenneth P. Glynn

[57] ABSTRACT

The present invention is directed to a method of printing ink upon a continuous substrate using a printing apparatus. First, the substrate is fed around a central impression cylinder which rotates so that the substrate successively passes through at least one face roll and a plurality of inking stations. When passing through each ink station, ink is heated to a predetermined temperature which is higher than the temperature of the central impression cylinder wherein the viscosity of the ink is dropped low enough so that the ink may be transferred to the substrate. Next, the ink at each inking station is applied to the substrate causing the temperature of the ink to drop and the viscosity to climb. This allows previous down inks to appear to be several times more viscous than the ink applied at the current inking station and to pull the ink off a printing plate in the direction of the substrate. Last, the inked substrate, which has passed through all inking stations, is cured at a curing station.

20 Claims, 2 Drawing Sheets

WET TRAPPING METHOD AND APPARATUS FOR LOW VISCOSITY RADIATION CURED PRINT

BACKGROUND OF THE INVENTION

1. Field of the Invention

The present invention relates to printing presses, and, more particularly, to a central impression press having wet offset printing.

2. Information Disclosure Statement

Generally, the current printing presses involve a dry or curing process before another color is printed on top of it or a wet offset process. These processes are part of an in-line press, central impression press or an offset press, all of which are described hereinafter.

In an in-line press every color must pass under a "face" roll before the next color is printed. Before passing through the face roll, each different color needs to be dried or cured in order to avoid tracking of the ink on a face roll, thereby damaging the image on the substrate.

In a central impression press, ink trapping is a dry process accomplished by the previous down ink being dried or cured before attempting a successive color on top of it. It uses a common impression cylinder for all print stations, and individual colors do not have to pass under a "face" roll before a successive color is trapped on top of Recent efforts to print UV curable or EB curable inks on central impression presses have utilized interstation UV curing. However, this method still has the disadvantages of the additional time and cost in the curing process.

An offset press uses a wet trapping process whereby ink is not dried between print stations. Like a central impression press, it is designed so successive colors do not need to pass under a "face" roll between print stations.

The successive colors are "wet trapped" by controlling the "tack" or viscosity of the inks through ink formulation. "Tack" is defined by the printing industry as being the force that is required to split an ink film between two rolls, usually measured by a Thwing Albert Inkometer. Generally, the previous down ink colors must be higher in tack than the colors to be printed on top of them. Because the previous down is tackler than the successive down ink, it pulls the successive ink off the printing plate to the substrate.

In addition to controlling the tack through ink formulation, the "tack" can be controlled through the quantity or "volume" of the ink being applied at each station. Since it requires less force to split an ink film between two rolls when there is more ink on the rolls, each successive ink station applies more volume than the previous one.

Depending upon the coverage, the volume accumulating on the substrate will increase rapidly, thus, limiting graphic quality and forcing the printer to increase the volume of each of the successive colors beyond a practical limit. Having multiple curing units and multiple face rolls increase the equipment cost. Moreover, UV curing units currently used on a central impression press generate IR energy or heat which is radiated on to the central impression drum causing heat problems. The present invention overcomes all of these disadvantages.

Notwithstanding the above-described current printing presses, there seems to be no central impression printing press that uses a wet trapping process. Furthermore, none of the current technology renders the present invention obvious or unpatentable thereover.

SUMMARY OF THE INVENTION

The present invention is directed to a method of printing ink upon a continuous substrate using a printing apparatus.

First, the substrate is fed around a central impression cylinder which rotates so that the substrate successively passes through at least one face roll and a plurality of inking stations. When passing through each ink station, ink is heated to a predetermined temperature which is higher than the temperature of the central impression cylinder and substrate wherein the viscosity of the ink is dropped low enough so that ink will transfer to the substrate. At a first inking station, the ink has a higher temperature and a lower viscosity than the substrate and consequently is pulled off a first printing plate onto the substrate Next, the ink at each remaining inking station is applied to the is substrate causing previous down inks to appear to be several times more viscous than the ink applied at the current inking station with the warmer temperature and to pull the ink off a printing plate in the direction of the substrate. Last, the inked substrate, which has passed through all inking stations, is cured at a curing station.

BRIEF DESCRIPTION OF THE DRAWINGS

The present invention will be more fully understood when the specification herein is taken in conjunction with the drawings appended hereto, wherein.

DETAILED DESCRIPTION OF THE PRESENT INVENTION

The purpose of the present invention is to provide a central impression printing press with a wet trapping process. The wet trapping process is accomplished by heating lower viscosity radiation curable ink on a conventional central impression press to a predetermined temperature higher than the temperature of the central impression cylinder and substrate. Depending upon the ink and equipment, the temperature difference fluctuates.

The predetermined higher temperature of the ink may vary at each inking station. However, the ink at each succeeding inking station in the printing process must be heated to at least the same temperature as the ink at the previous inking station.

The increase in temperature of the radiation curable ink will decrease the viscosity of the ink low enough so that the ink will be transferred to the substrate. Once the ink transfers to the substrate, the temperature of the ink on the substrate will immediately begin to decrease and its viscosity will increase quickly.

At a first inking station, a first down ink will transfer to the substrate due to the ink's low viscosity. At subsequent inking stations, because of the temperature change, the previous down inks will appear to be several times more viscous compared to when the current ink is transferred to the substrate. Thus, the previous down ink's tack will pull the ink being printed off the plate in the direction of the substrate.

At each inking station, there includes an ink pan containing ink, an enclosed doctor blade assembly, an anilox roll and a printing plate. The ink could be heated at anyone of the parts of the inking station and still accomplish the transfer to the substrate.

The above described process is accomplished with the use of only one curing station at the end of the cycle. Thus, the steps of curing after each inking is eliminated from a conventional central impression press.

Figure 1:
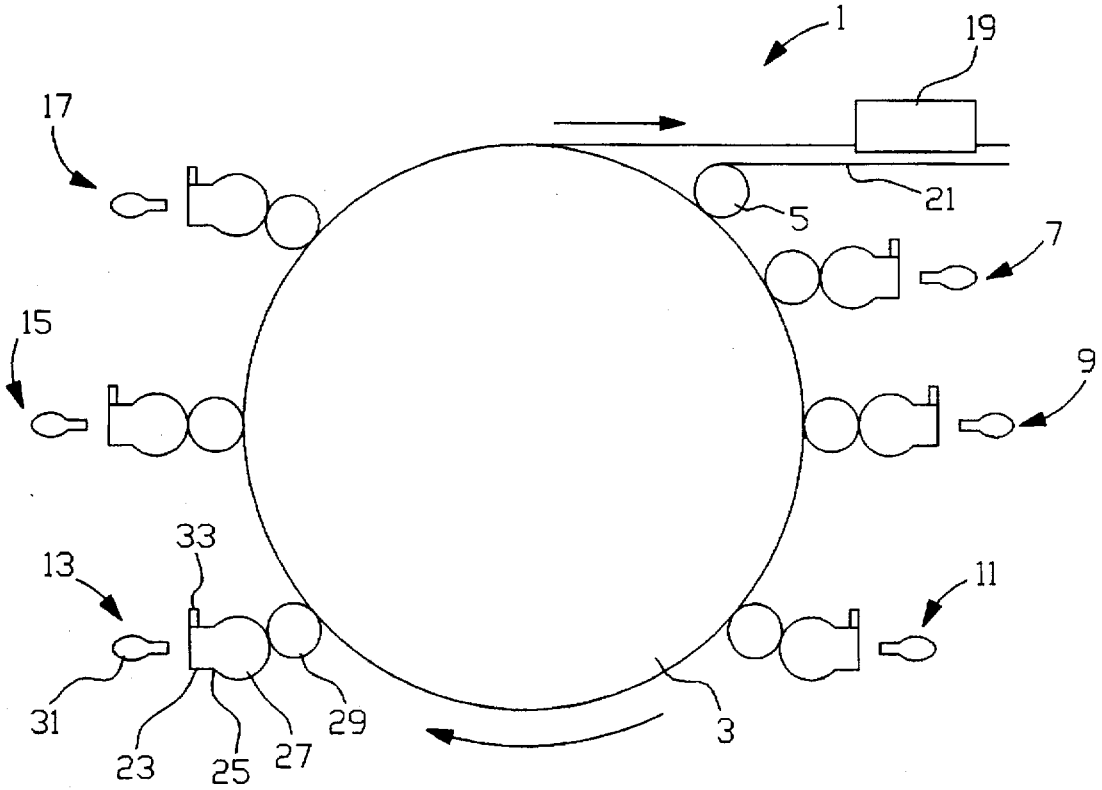
FIG. 1 shows a schematic view of a present invention apparatus for printing on a substrate through a wet trapping method.

Referring now to FIG. 1, there is shown a schematic of a present invention central impression press with wet trapping 1. The central impression press with wet trapping includes a central impression cylinder 3, a face roll 5, a plurality of color inking stations 7, 9, 11, 13, 15 and 17, and a curing unit 19. Although there are six inking stations in this embodiment, there could be any number, more than one, inking stations.

The face roll 5 is an idler roll which sets up the print side of a substrate 21 for passage through the plurality of color inking stations 7, 9, 11, 13, 15 and 17. The central impression cylinder 3 rotates in a clockwise or counterclockwise direction at a constant speed. In FIG. 1, the central impression cylinder 3 is shown rotating in a clockwise direction. However, the face roll 5 could be positioned on an adjacent side and the central impression cylinder 3 would rotate counterclockwise.

The rotation of the central impression cylinder 3 causes the substrate 21 to pass continuously through the plurality of color inking stations 7, 9, 11, 13, 15 and 17. Each color inking station 7, 9, 11, 13, 15 and 17 includes at least one ink pan 23 having radiation curable ink (not shown), an enclosed doctor blade assembly 25, an anilox roll 27 and a plate cylinder 29. The configuration of each color inking station 7, 9, 11, 13, 15 and 17 is typical and well known in the art. The ink is of low viscosity.

The ink at each inking station 7, 9, 11, 13, 15 and 17 is heated by a heating means 31 and the temperature is regulated by a temperature measuring means 33. The heating means may be an electric heat gun, an electric heater, electrical coils or the like. The temperature measuring means may be a metallic thermometer, a thermostat or the like.

In operation, a substrate 21 is wound through the at least one face roll 5 and due to the rotation of the central impression cylinder 3 passes successively through each of the color inking stations 7, 9, 11, 13, 15 and 17. At each of the color inking stations 7, 9, 11, 13, 15 and 17, the ink is heated to a predetermined temperature. A range for the predetermined temperature of the ink is from approximately 90° Fahrenheit to approximately 150° Fahrenheit, a preferred range is from approximately 100° Fahrenheit to approximately 140° Fahrenheit and a most preferred range is from approximately 100° Fahrenheit to approximately 120° Fahrenheit.

The central impression cylinder 3 and the substrate 21 are controlled to a predetermined temperature, which is lower than the predetermined temperature of the ink. A range for the predetermined temperature of the central impression cylinder 3 and the substrate 21 is from approximately 70° Fahrenheit to approximately 100° Fahrenheit, a preferred range is from approximately 75° Fahrenheit to approximately 90° Fahrenheit and a most preferred range is from approximately 75° Fahrenheit to approximately 85° Fahrenheit.

The increase in temperature of the radiation curable ink will drop the viscosity of the ink low enough for the ink to be transferred to the substrate 21. The ink passes from the ink pan 23 to the enclosed doctor blade assembly 25, to be split off through an anilox roll 27 causing a portion of the ink to pass through the plate cylinder 27 and onto the substrate 21.

In this process, the ink can be heated at anyone of the ink pan, the enclosed doctor blade assembly 25, the anilox roll 27 or the plate cylinder 27. As long as the ink has a higher temperature by the time it meets the substrate 21, the viscosity will be lowered and it will adhere to the substrate 21.

At the first inking station 7, the lower temperature of the substrate 21 and the central impression cylinder 3 will cause the ink to be pulled off the printing plate in the direction of the substrate. At this point the temperature of the ink will decrease and its viscosity will increase.

At the subsequent inking stations 9, 11, 13, 15 and 17 ink, once the ink leaves the plate cylinder 27 and transfers to the substrate 21, the temperature of the ink on the substrate 21 will immediately begin to decrease and the ink's viscosity will increase quickly. Since the mass ratio of the ink to the substrate 21 and the temperature controlled central impression cylinder 27 is severe, the temperature change wall be almost instantaneous. Because of the temperature change, the previous down inks will appear to be several times more viscous compared to when the warmer and current ink is transferred to the substrate. Thus, the previous down ink's tack will pull the current ink being printed off the plate in the direction of the substrate 21.

At each inking station 7, 9, 11, 13, 15 and 17, a different predetermined color ink may be applied.

After the printing process is completed at each station 7, 9, 11, 13, 15 and 17, the substrate 21 is then passed through the curing or drying station 19. The curing station 19 may be UV curable or EB curable.

Figure 2:
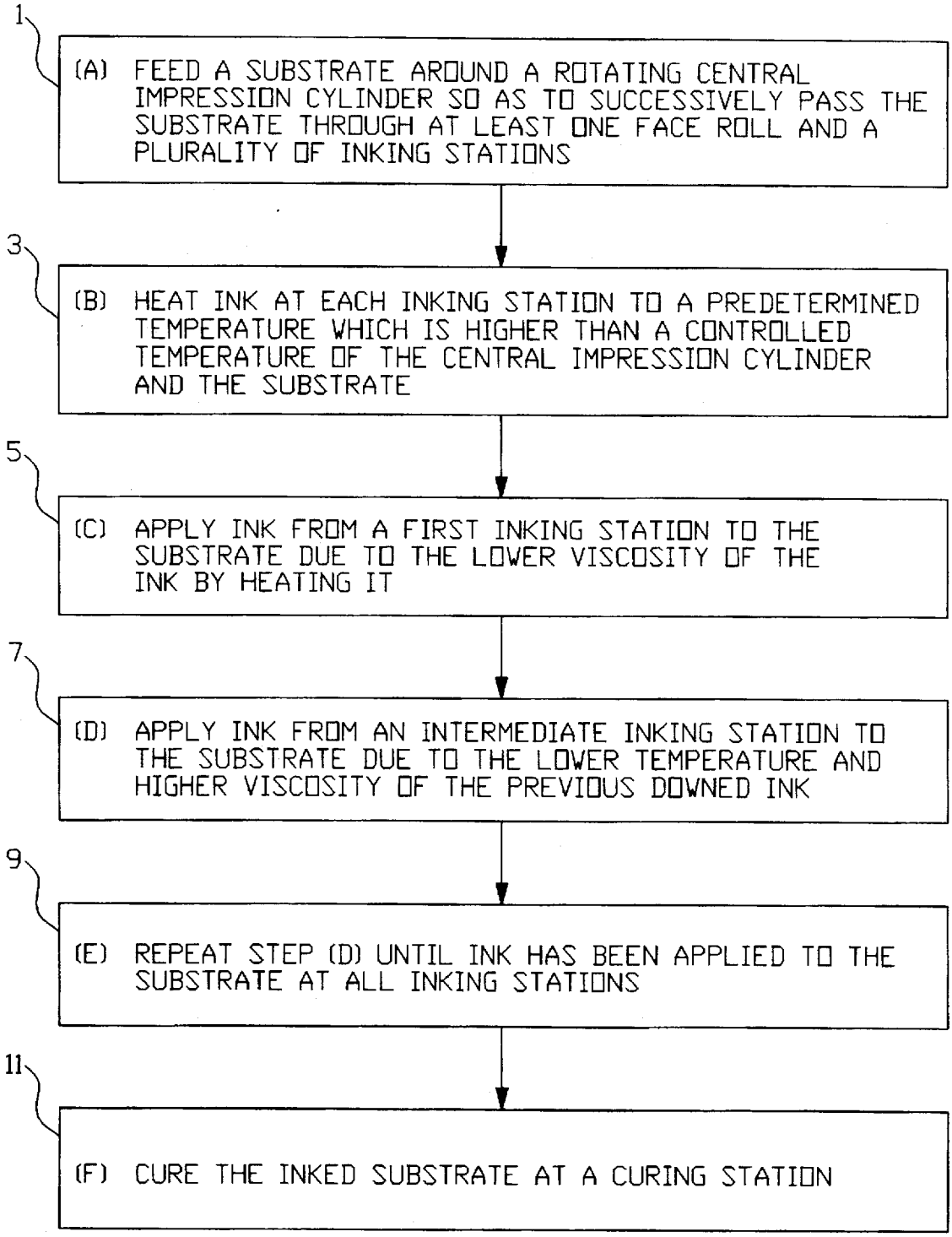
FIG. 2 shows a diagrammatic representation of a preferred embodiment of the present invention.

Referring now to FIG. 2, there is shown a flow diagram of the steps included in printing ink upon a substrate, as disclosed by the present invention. Thus, frame 1 shows step (A) wherein the substrate is prepared for inking by feeding it around a rotating central impression cylinder and letting it successively pass through at least one face plate and a plurality of inking stations.

At each inking station a different predetermined ink is applied. Next, frame 3 shows step (B) wherein ink at each inking station is heated to a predetermined temperature which is higher than the controlled temperature of the central impression cylinder and the substrate. The predetermined higher temperature allows the ink at each inking station to leave a plate cylinder and adhere to the substrate.

Frame 5 shows step (C) wherein ink is applied to the substrate at a first inking station. Because the ink is heated, the viscosity of the ink is decreased and therefore adheres to the substrate. At the next inking station, in this case, an intermediate inking station, as shown in frame 7, the current ink is applied to the substrate due to the lower temperature and higher viscosity of the previous downed ink. As the current ink, which has a higher temperature than the inked substrate, meets the substrate, the lower temperature of the substrate causes the previous down ink to be more viscous and therefore pulls the ink from the intermediate inking station in the direction of the substrate, Frame 9 shows the repetition of step (C) for the remaining inking stations of the plurality of inking stations. Previous down ink is more viscous and therefore appears to be tackler than the current station ink causing the current ink to be pulled in the direction of the substrate.

Frame 9 shows step (E) wherein the inked substrate is cured at one curing station as a last step. The station may be UV or EB curable.

Obviously, numerous modifications and variations of the present invention are possible in light of the above teachings. For example, a plurality of doctor blades could be employed, as well as a plurality of ink pans, and a plurality of central impression cylinders. It is therefore understood that within the scope of the appended claims, the invention may be practiced otherwise than as specifically described herein.

What is claimed is:

1. A method of printing ink upon a continuous substrate using a printing apparatus comprising the steps of:

(a) feeding a continuous substrate around a central impression cylinder that rotates so as to successively pass the substrate through at least one face roll and a plurality of inking stations;

(b) heating ink located at each inking station to a first predetermined temperature, said predetermined temperature being higher than a second predetermined temperature of said central impression cylinder of said substrate wherein the viscosity of said ink is dropped low enough so that said ink will be transferred to said substrate;

(c) applying a first ink from a first inking station to the substrate wherein the temperature of the first ink decreases and the viscosity increases as the first ink is pulled off a first printing plate in the direction of the substrate;

(d) applying an intermediate ink from an intermediate inking station to the substrate wherein previously applied ink on the substrate has a lower temperature and a higher viscosity than said intermediate ink, causing said previously applied ink to pull said intermediate ink off an intermediate printing plate in the direction of the substrate;

(e) repeating step (d) at each one of the remaining of said plurality of inking stations;

(f) curing the inked substrate which has passed through said plurality of inking stations at a curing station.

2. The method of claim 1 further comprising the step of feeding the substrate through said printing apparatus at a continuous and constant speed.

3. The method of claim 2 wherein the ink is radiation curable and has low viscosity.

4. The method of claim 3 wherein a range of said first predetermined temperature of the ink is approximately 90° Fahrenheit to approximately 150° Fahrenheit.

5. The method of claim 4 wherein a preferred range of said first predetermined temperature of the ink is approximately 100° Fahrenheit to approximately 140° Fahrenheit.

6. The method of claim 5 wherein a most preferred range of said first predetermined temperature of the ink is approximately 100° Fahrenheit to approximately 120° Fahrenheit.

7. The method of claim 6 wherein a range of said second predetermined temperature of said central impression cylinder and the substrate is approximately 70° Fahrenheit to approximately 100° Fahrenheit.

8. The method of claim 7 wherein said curing step is performed at a station selected from the group consisting of UV curable and EB curable.

9. The method of claim 8 wherein said inking station includes an ink pan, an enclosed doctor blade, an anilox roll, and a printing plate.

10. The method of claim 9 wherein said inking station further includes a heating means and a temperature regulating means.

11. A printing apparatus for printing ink upon a continuous substrate comprising:

(a) a central impression cylinder which rotates so as to cause a continuous substrate to pass through a plurality of processing stations;

(b) at least one face roll for facing a print side of the substrate;

(c) a plurality of sequentially arranged inking stations for applying a predetermined ink at each station to the substrate and heating means located at each of said plurality of inking stations adapted to perform wet trapping and adapted to heat ink at said inking station to a first predetermined temperature, which is higher than a second predetermined temperature of said central impression cylinder and said substrate, each sequential inking station and heating means being adapted to heat each sequentially applied ink to a higher temperature than the previously applied ink; and, (d) a curing station adapted for curing an inked substrate.

12. The apparatus of claim 11 further including a temperature regulating means.

13. The apparatus of claim 12 wherein the predetermined ink applied at said inking station is radiation curable and has low viscosity.

14. The apparatus of claim 13 wherein said first predetermined temperature of the ink at a succeeding inking station is at least equal to said first predetermined temperature of the ink at a preceding inking station.

15. The apparatus of claim 14 wherein said heating means is adapted to heat in a range of said first predetermined temperature of the ink is approximately 90° Fahrenheit to approximately 150° Fahrenheit.

16. The apparatus of claim 15 wherein a preferred range for said heating means of said first predetermined temperature of the ink is approximately 100° Fahrenheit to approximately 140° Fahrenheit.

17. The apparatus of claim 16 wherein a most preferred range for said heating means of said first predetermined temperature of the ink is approximately 100° Fahrenheit to approximately 120° Fahrenheit.

18. The apparatus of claim 11 wherein said inking station includes an ink pan, an enclosed doctor blade, an anilox roll, and a printing plate.

19. The apparatus of claim 18 wherein said curing station UV curable.

20. The apparatus of claim 18 wherein said curing station is EB curable.

* * * * *